US011399598B2

(12) United States Patent
Saar

(10) Patent No.: US 11,399,598 B2
(45) Date of Patent: Aug. 2, 2022

(54) ORNAMENT CLAMP

(71) Applicant: Haim Moshe Saar, Rishon Lezion (IL)

(72) Inventor: Haim Moshe Saar, Rishon Lezion (IL)

( * ) Notice: Subject to any disclaimer, the term of this patent is extended or adjusted under 35 U.S.C. 154(b) by 0 days.

(21) Appl. No.: 16/923,732

(22) Filed: Jul. 8, 2020

(65) Prior Publication Data

US 2021/0007445 A1 Jan. 14, 2021

Related U.S. Application Data

(60) Provisional application No. 62/871,366, filed on Jul. 8, 2019.

(51) Int. Cl.
*A44B 11/06* (2006.01)

(52) U.S. Cl.
CPC ..... *A44B 11/06* (2013.01)

(58) Field of Classification Search
CPC ..... A44B 11/06; A43C 9/02; A43C 15/006; A43C 3/001; A43B 3/0078; A43B 23/24; A45D 15/006; Y10T 24/4406
See application file for complete search history.

(56) References Cited

U.S. PATENT DOCUMENTS 2,500,694 A * 3/1950 Matsumoto ..... A41F 1/00 24/662
3,950,076 A * 4/1976 Carlson ..... B62J 6/20 359/519
3,965,952 A * 6/1976 Rivman ..... A44B 17/0029 383/86
3,979,802 A * 9/1976 Bongartz ..... A44B 17/0052 24/630
4,231,141 A * 11/1980 Derrick ..... E04H 15/646 160/380
4,712,319 A * 12/1987 Goha ..... A43B 1/0036 359/518
5,685,174 A * 11/1997 Balzer ..... A44B 17/0082 24/578.12
6,718,559 B1 * 4/2004 Davidson ..... A42B 3/0406 2/209.13
2018/0140051 A1 5/2018 Jugeau

FOREIGN PATENT DOCUMENTS

JP H01155812 U 10/1989
JP 2000245506 A 9/2000
WO 2016162651 A2 10/2016

* cited by examiner

*Primary Examiner* — Robert Sandy
*Assistant Examiner* — Rowland Do
(74) *Attorney, Agent, or Firm* — Browdy and Neimark, P.L.L.C.

(57) ABSTRACT

An ornament clamp apparatus attachable/removable to/from a lace including an ornament body and a clamping assembly for cooperating therewith for attaching the ornament body to the lace; the clamping assembly including a male connector and a female connector, the male connector having curved arms extending downwards from the ornament body, and the female connector possessing a U-shape structure which fits onto the male connector.

4 Claims, 13 Drawing Sheets

ORNAMENT CLAMP

FIELD OF THE INVENTION

The present invention generally relates to ornament clamps. More specifically, the present invention relates to ornament clamps for article of wearing apparels, hair accessories and the like.

BACKGROUND OF THE INVENTION

Various types of ornamental elements to be employed with wearing apparels and hair accessories are available nowadays. To secure such ornamental elements to the article, many of them have a complicated structure to be permanently fixed to the article by a fastening device or by adhering thereto by an adhesive or the like.

Such ornaments that are permanently fixed to the article cannot be replaced. Thus, if the article becomes ragged, the ornamental element may be discarded together with the article resulting in waste.

Therefore, an aim of the present invention is to provide an ornament apparatus, fixable to an article, that is quickly and securely attached to and removed from the article.

SUMMARY OF THE INVENTION

In accordance with some embodiments, there is provided an ornament clamp apparatus attachable/removable to/from a lace.

The ornament clamp apparatus comprises an ornament body and a clamping assembly for cooperating therewith for attaching said ornament body to the lace. The clamping assembly comprises a male connector and a female connector. The male connector has curved arms extending downwards from the ornament body, and the female connector possesses a U-shape structure which fits onto the male connector.

The present invention provides an ornament clamp apparatus attachable/removable to/from a lace comprising:

an ornament body and a clamping assembly for cooperating therewith for attaching said ornament body to said lace; said clamping assembly comprises a male connector and a female connector, said male connector has curved arms extending downwards from said ornament body, and said female connector possesses a U-shape structure which fits onto the male connector.

According to some embodiments of the present invention the male connector comprises at least one niche on its outer surface to fixedly attach to said female connector.

According to some embodiments of the present invention said female connector comprises at least one bulge on its inner surface to fixedly attach to said male connector.

According to some embodiments of the present invention said female connector comprises at least one bulge, on its outer surface, to be grabbed by a user for attaching/removing said apparatus to/from said lace.

The present invention an ornament clamp apparatus attachable to a lace comprising: an ornament body and a clamping assembly for cooperating therewith for attaching said ornament body to said lace; said clamping assembly comprises a male connector and a female connector, said male connector has curved arms extending from said ornament body, and said female connector has an open-shape structure which fits onto the male connector.

According to some embodiments of the present invention The ornament clamp apparatus of claim 1 wherein the two curved arms are semi-flexible arms.

According to some embodiments of the present invention the curved arms have ends that curve towards each other while maintaining a separation distance in between them, wherein said space is designed to allow inserting the lace, hence the integration creating inner pressure between the male connector and a female connector to maintain secure connection.

According to some embodiments of the present invention the curved arms comprise niches on their outer surface and male connector has bulges, said bulges adapted to be fixedly attach to female connector niches.

According to some embodiments of the present invention the female connector 108 has a U-shaped structure which fits to male connector 106.

According to some embodiments of the present invention the curved arms comprise niches on their outer surface and male connector has bulges, said bulges adapted to be fixedly attach to female connector niches.

According to some embodiments of the present invention the female connector 108 has circular opening with two legs.

According to some embodiments of the present invention the two legs form niches and the male connector has bulges adapted to fit said niches According to some embodiments of the present invention the two legs form bulges and the male connector has niches adapted to fit said niches According to some embodiments of the present invention the two legs form bulges and the male connector has niches adapted to fit said niches According to some embodiments of the present invention the female connector has pin extending from the inner opening, said pin having ball shape ending, designed to fit into the space with in the male connector, wherein the ball diameter is larger than the space length, creating a secure connection between the male and female connector.

According to some embodiments of the present invention the female connector has pin extending from the inner opening, said pin having ball shape ending, designed to fit into the spade with in the male connector, wherein the ball diameter is larger than the space length, creating a secure connection between the male and female connector.

According to some embodiments of the present invention the female connectors are connected by sliding the female connector from the side to male connector.

According to some embodiments of the present invention the female connector may include a slits at outer sides and the male connector has corresponding bulges at the outer which fits into slits while sliding the male connector onto the female connector.

DETAILED DESCRIPTION OF SOME EMBODIMENTS OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides an ornament clamp apparatus configured for attaching an ornamental design to laces such as shoelaces, laces for hair accessories and the like.

The design ornament may have any desired shape, and the ornament clamp apparatus is designed to allow clamping ornaments to laces easily without loosening/untying the laces.

According to some embodiments of the present invention, the ornament clamp apparatus is made of a rigid or semi-rigid material such as polymeric materials, silicon, wood, metal and the like.

Figure 1:
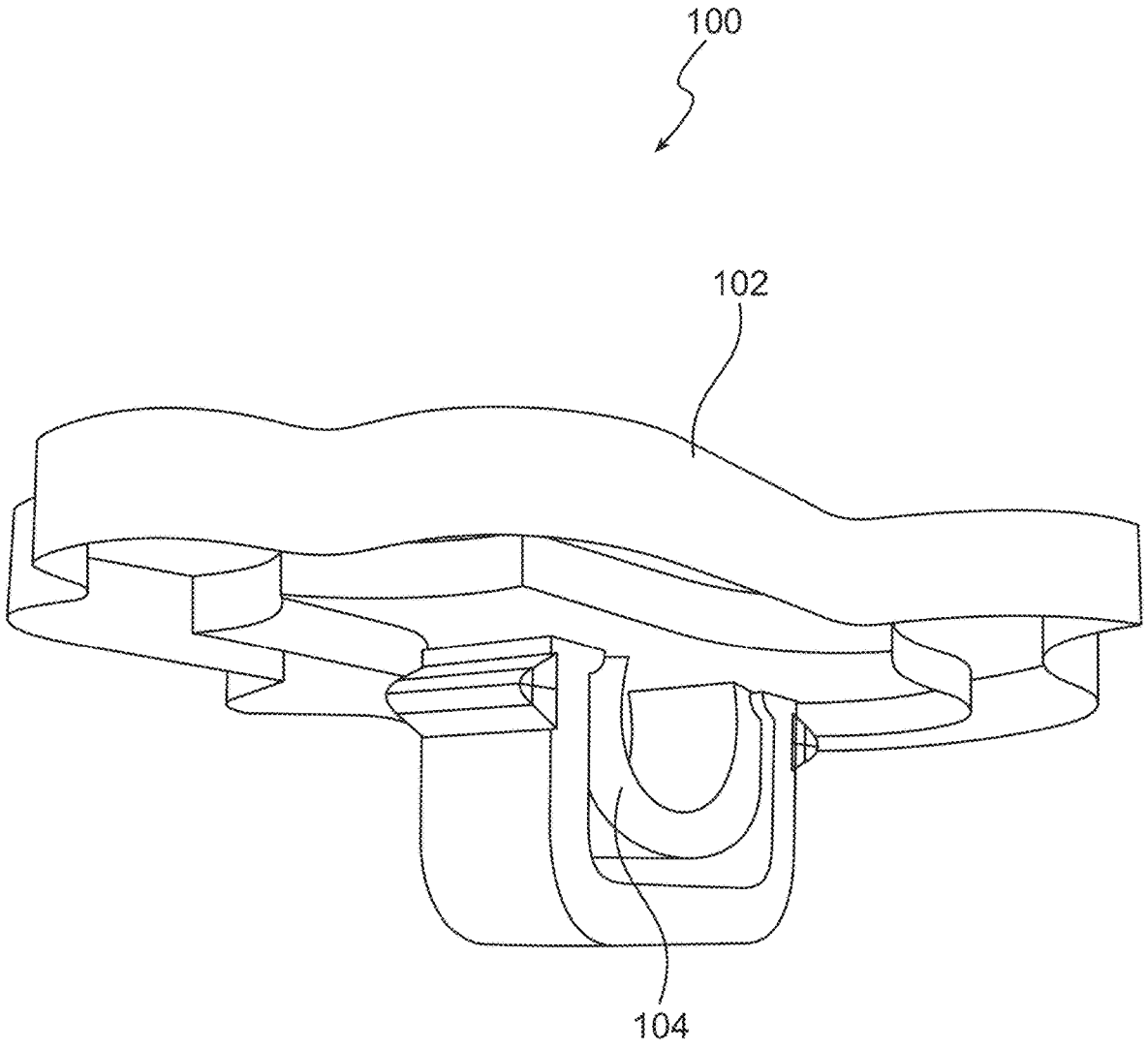
FIG. 1 is a perspective view of an ornament clamp apparatus according to some embodiments of the present invention.

FIG. 1 is a perspective view of an ornament clamp apparatus 100 according to some embodiments of the present invention.

The ornament clamp apparatus 100 comprises an ornament body 102 and a clamping assembly 104.

Figure 2A:
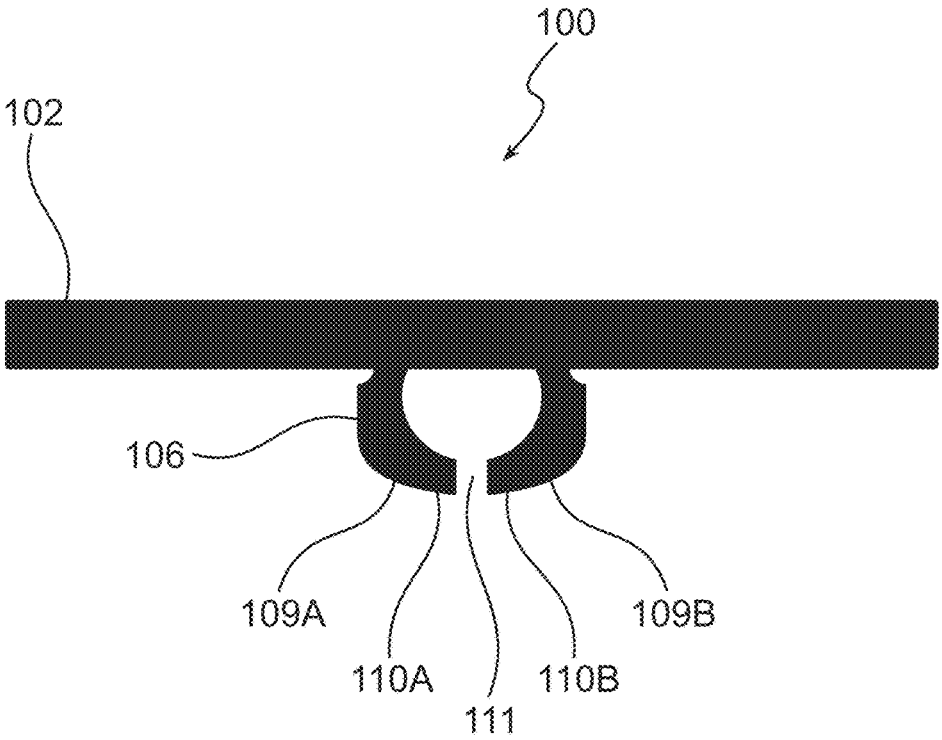
FIGS. 2A&2B are side views of the ornament clamp apparatus according to some embodiments of the present invention.

FIGS. 2A&B are side views of the ornament clamp apparatus 100 according to some embodiments of the present invention.

Figure 2B:
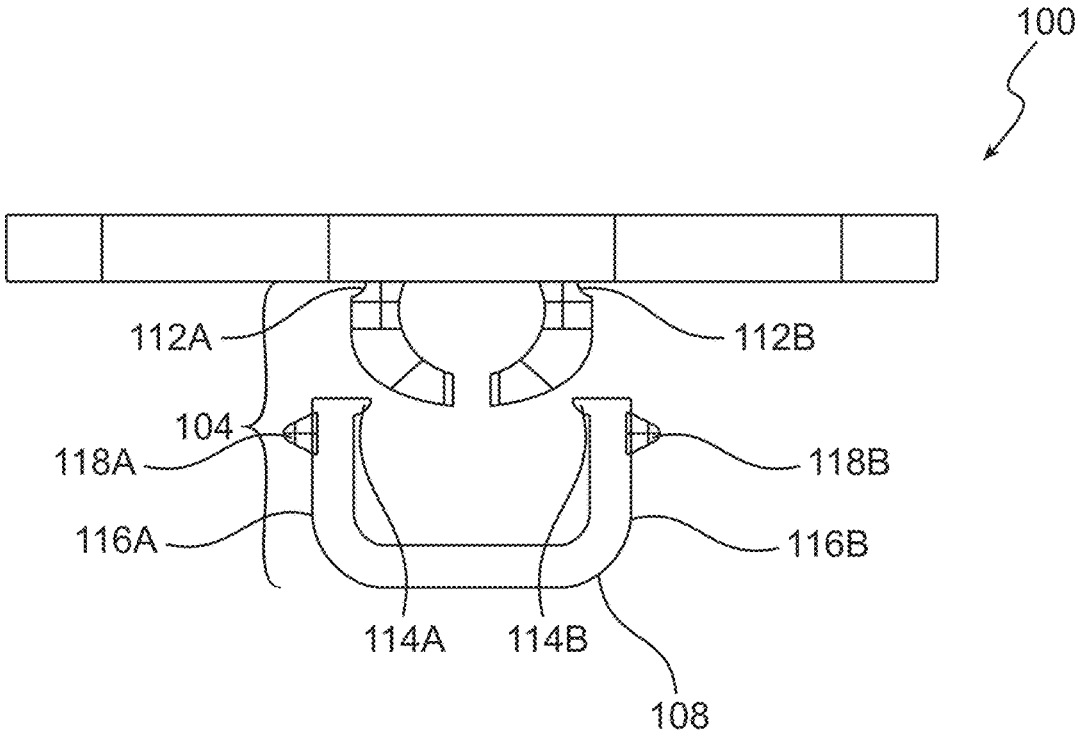

As seen in the figures, clamping assembly 104 comprises a male connector 106 and a female connector 108. In FIG. 2A the male connector 106 and a female connector 108 are fastened together while in FIG. 2B the male connector 106 and a female connector 108 are kept apart.

As seen in the figures, male connector 106 has two curved semi-flexible arms 109A and 109B extending downwards from ornament 102. Curved arms 109A and 109B have ends 110A&B that curve towards each other while maintaining a separation distance in between them, i.e., having a shape of an open ring.

As seen in the figures, curved arms 109A and 109 B comprise niches 112A&B on their outer surface to fixedly attach to female connector 108 as described below.

As seen in the figures, the female connector 108 possesses a U-shaped structure which fits to male connector 106. Female connector 108 comprises bulges 114A&B extending of the inner surface of legs 116A&B and outer bulges 118A&B extending of the outer surface of legs 116A&B.

Bulges 114A&B are shaped to fit within niches 112A&B on the outer surface of male connector 106. Outer bulges 118A&B enable easy gripping of the female member 108 for fixedly attaching/removing the ornament clamp apparatus 100 to/from a lace.

Thus, in accordance with some embodiments of the present invention, the male connector 106 and the female connector 108 may be integrally connected to each other by applying a small force on the female connector, configured to tightly fit onto male connector 106. (During the connection the parts 109A&B are pressed. The size of the space 111 and the space of the U shape are designed such when are integrated an inner pressure is created holding together the two parts.

According to some embodiments the male and female connectors are connected by sliding the female connector from the side to male connector. Optionally, according this embodiment the female connector may include a slits at outer sides and the male connector has corresponding bulges at the outer which fits into slits while sliding the male connector onto the female connector.

Figure 3A:
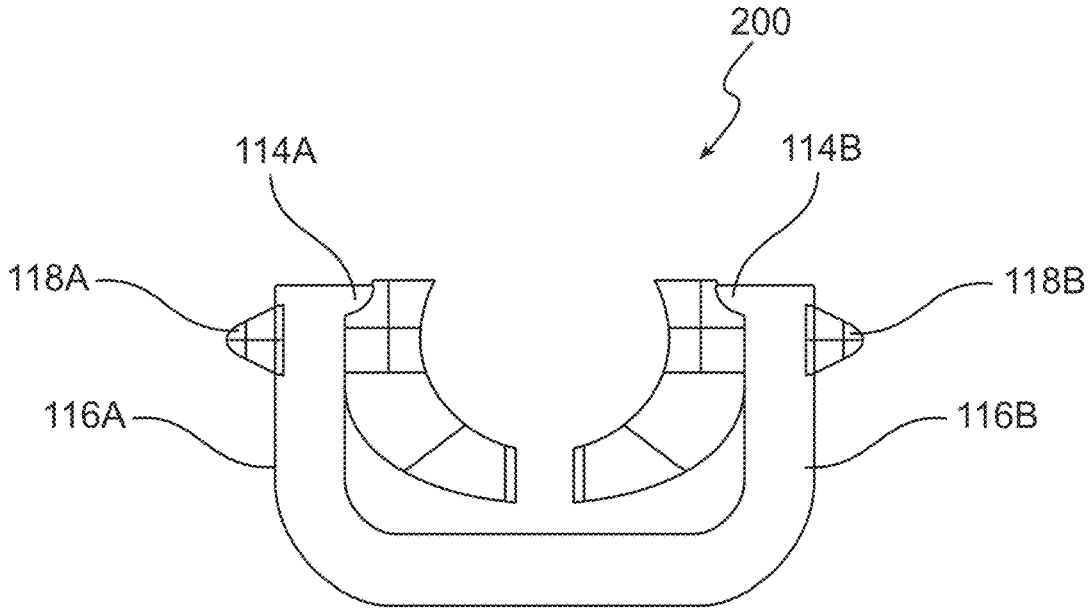
FIGS. 3A&3B are side-views of clamping assembly in accordance with some embodiments of the present invention.
Figure 3B:
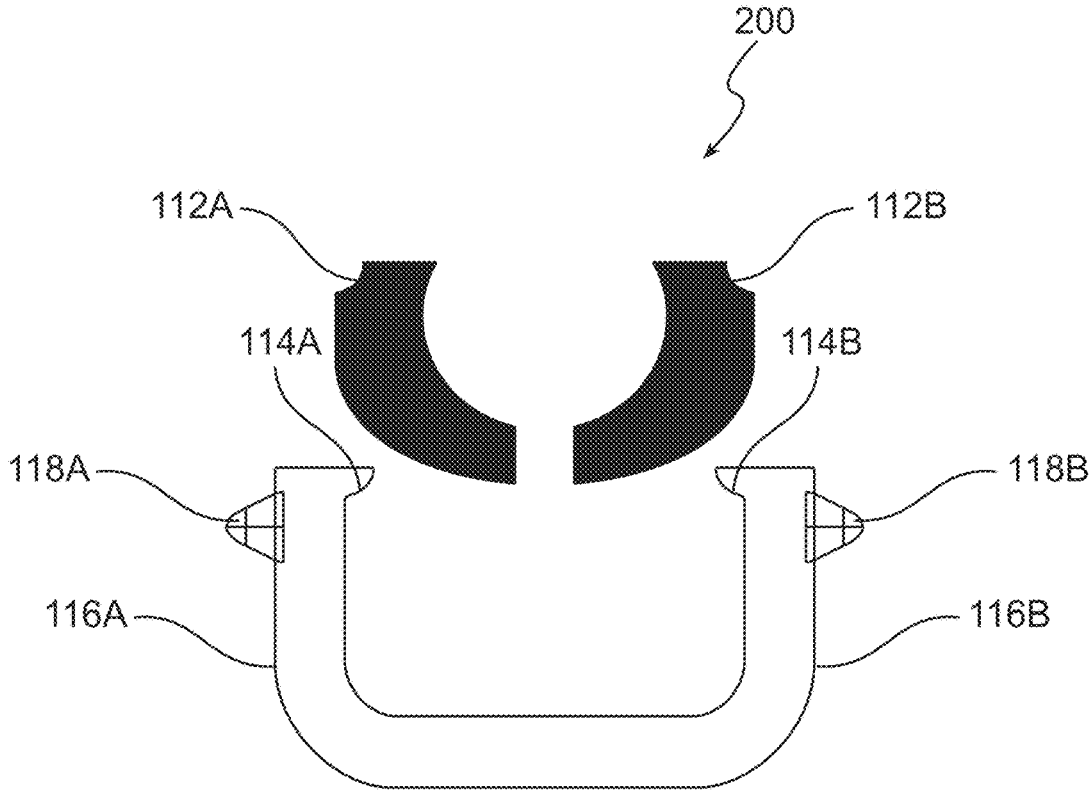

FIGS. 3A&B are side-views clamping assembly 104 in accordance with some embodiments of the present invention.

Seen clearly in the figures are 114A&B and 118A&B protruding from the inner surface and the outer surface of legs 116A&B respectively.

Bulges 118A&B are shaped to fit within niches 112A&B on the outer surface of male connector 106 while outer bulges 118A&B are to be gripped by a user for fixedly situating/removing the ornament clamp apparatus 100 on/from a lace.

In accordance with some embodiments of the present invention, attaching the ornament clamp apparatus 100 to a lace comprising the following stages:

inserting a lace through male connector 106;

configuring the female connector 108 to tightly fit onto male connector 106; and applying a small force on the female connector 108 to fasten with the male connector.

Figure 4:
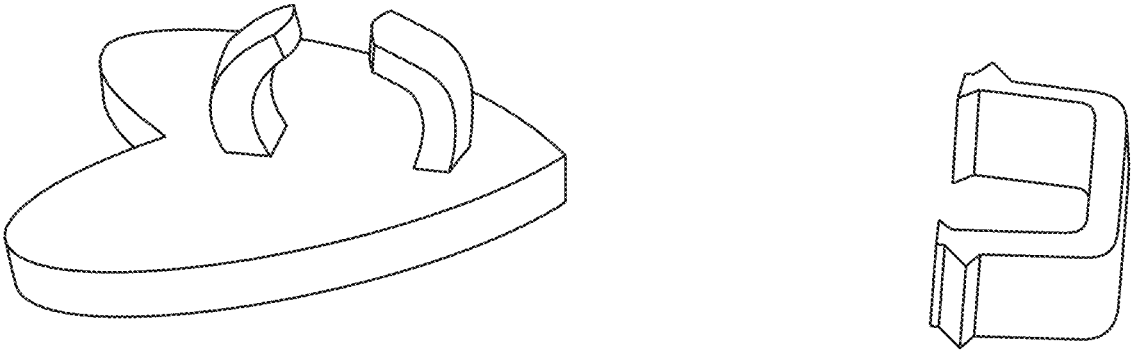
FIG. 4 is picture of the clamping assembly in an assembled state, in accordance with some embodiments of the present invention.

FIG. 4 is an exploded view of the clamping assembly in accordance with some embodiments of the present invention.

Figure 5:
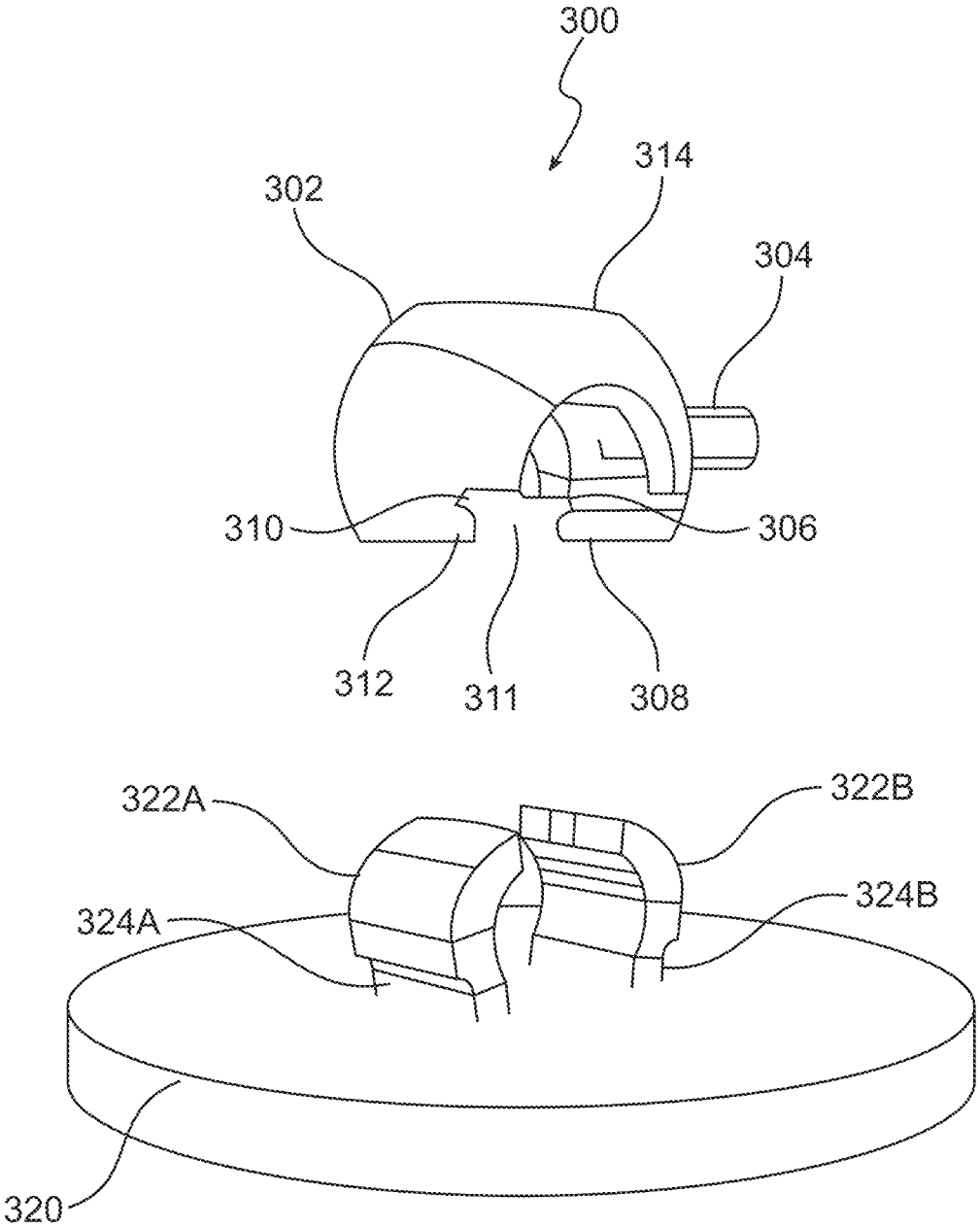
FIG. 5 is a perspective view of an ornament clamp apparatus according to some embodiments of the present invention.

FIG. 5 is a perspective view of an ornament clamp apparatus according to some embodiments of the present invention.

According to this embodiment the female connector 302 has 3D circular shape having curved opening 306 and legs 312 and 308 designed to create bulge on each side (in the FIG. only the left niche is seen 310). Optionally the female connector 302 has gripping element 304 to enable easy departing of the clip.

The male connector is comprised of two curved legs 322A and 324 B, each attached on one end to the ornament 320. The two distal ends of the legs are designed to be spaced from each other, creating an opening for inserting the lace. Each leg creating a niche 324A, and 324B respectively, the niche is designed to enable the respective bulge to fit in, resulting secure connection between the two parts.

Figure 6A:
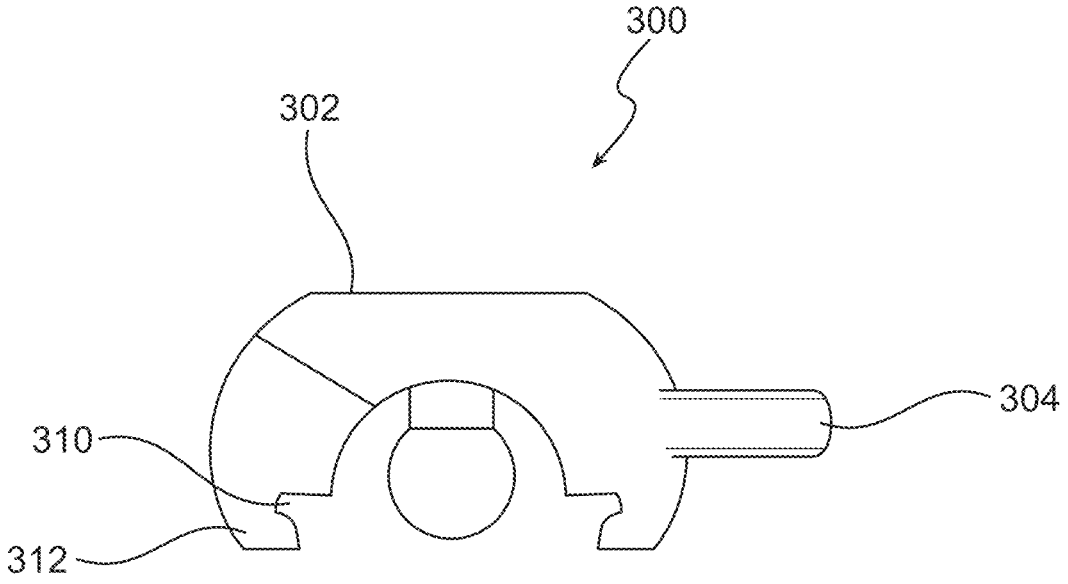
FIGS. 6A&6B are side views of the ornament clamp apparatus according to some embodiments of the present invention.
Figure 6B:
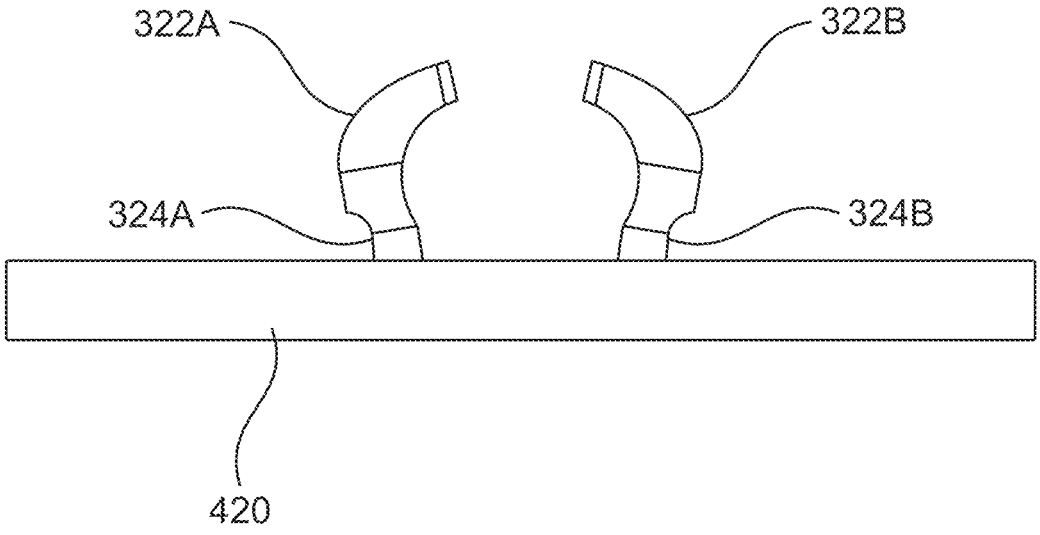

FIGS. 6 &6A are side views of the ornament clamp apparatus according to some embodiments of the present invention.

Bulges 314A&B are shaped to fit within niches 312A&B on the outer surface of male connector 306 while outer bulges 318A&B are to be gripped by a user for fixedly situating/removing the ornament clamp apparatus 300 on/from a lace.

Figure 7:
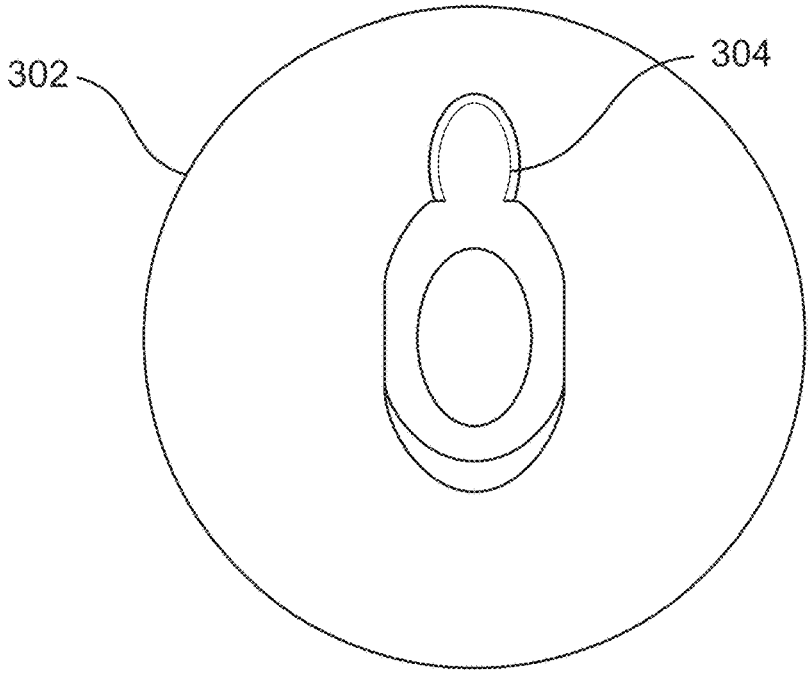
FIG. 7 is a top view of the ornament clamp female part apparatus according to some embodiments of the present invention.

FIG. 7 is a top view of the ornament clamp female part apparatus according to some embodiments of the present invention.

Figure 8:
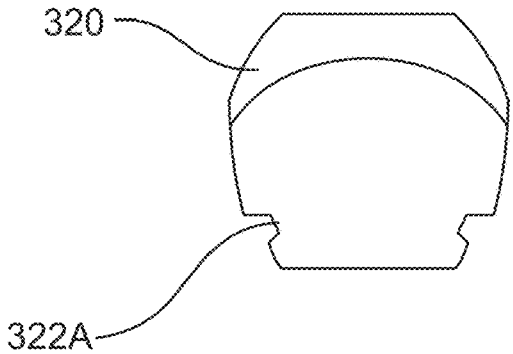
FIG. 8 is a side view of the ornament clamp male part apparatus according to some embodiments of the present invention.
Figure 8:
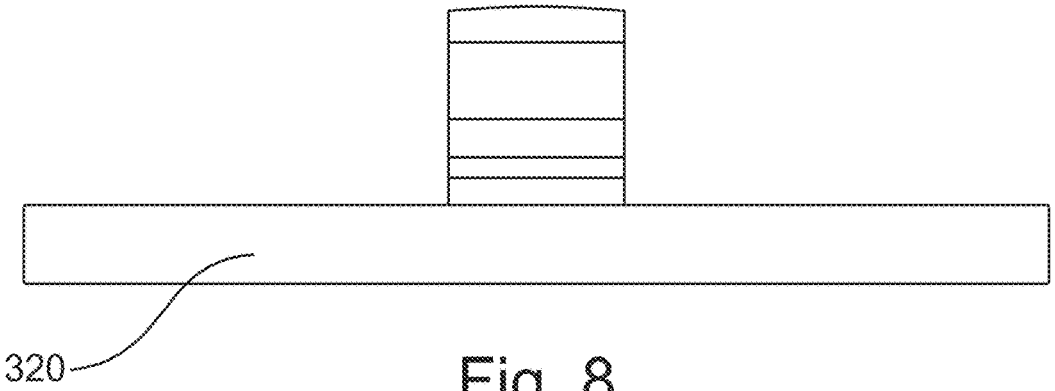

FIG. 8 is a side view of the ornament clamp male part apparatus according to some embodiments of the present invention.

Figure 9:
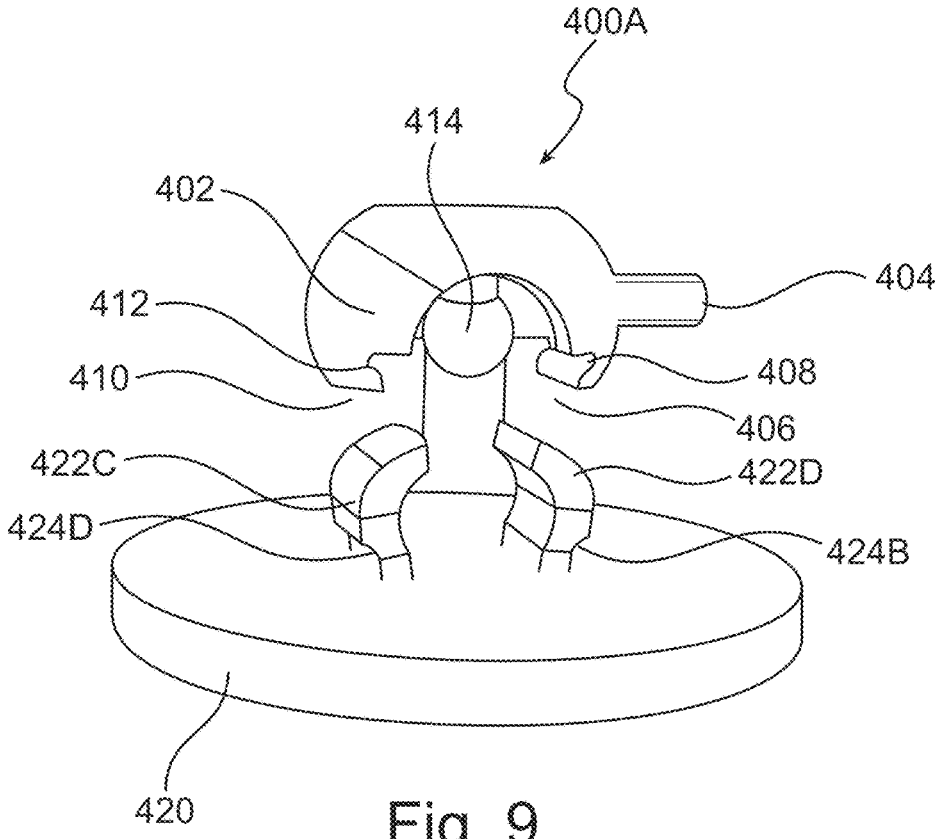
FIG. 9 is a perspective view of an ornament clamp apparatus according to some embodiments of the present invention.

FIG. 9 is a perspective view of an ornament clamp apparatus 4A according to some embodiments of the present invention.

According to this embodiment the female connector 402 has 3D circular shape having curved opening 406 and legs 412 and 408 designed to create niche on each side (in FIG. 9 only the left niche is seen 410). Optionally the female connector 302 has gripping element 304 to enable easy departing of the clip. Optionally the female connector 402 has pin 414 designed to fit in the space 411 of the male connector, the pin ending has a ball shape diameter is wider than the opening space 411, inserted by applying pressure, enabling secure connection.

The male connector is comprised of two curved legs 422A and 424B, each attached on one end to the ornament 420. The two distal ends of the legs are designed to be spaced from each other, creating an opening for inserting the lace. Each leg creating a bulge 424A, and 424B respectively, the niche is designed to enable the respective bulge to fit in, resulting secure connection between the two parts.

Figure 10:
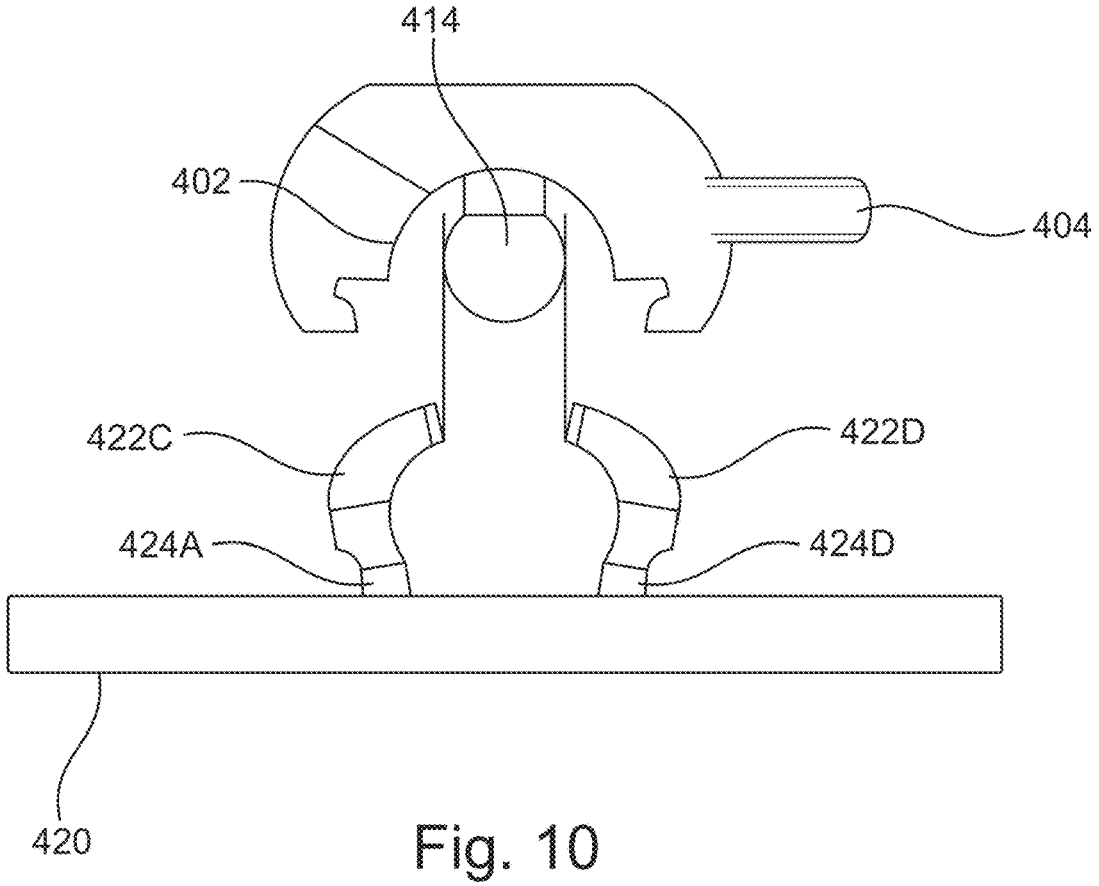
FIG. 10 is a side view of the ornament clamp apparatus according to some embodiments of the present invention.

FIG. 10 is a side view of the ornament clamp apparatus according to some embodiments of the present invention.

Figure 11:
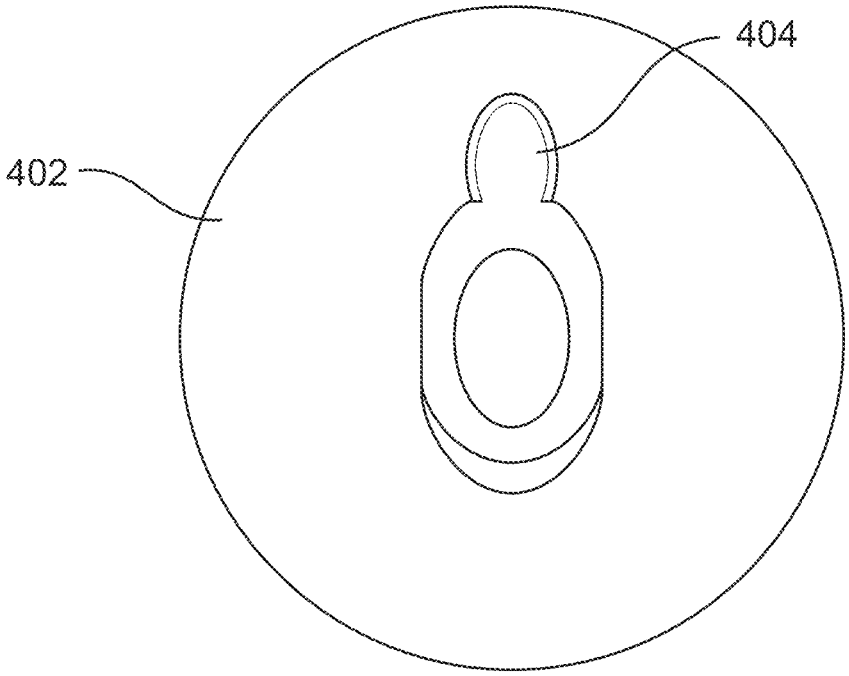
FIG. 11 is a top view of the ornament clamp female part apparatus according to some embodiments of the present invention.

FIG. 11 is a top view of the ornament clamp female part apparatus according to some embodiments of the present invention.

Bulges 418A&B are shaped to fit within niches 412A&B on the outer surface of male connector 402 while outer bulges 418A&B are to be gripped by a user for fixedly situating/removing the ornament clamp apparatus 400 on/from a lace.

Figure 12:
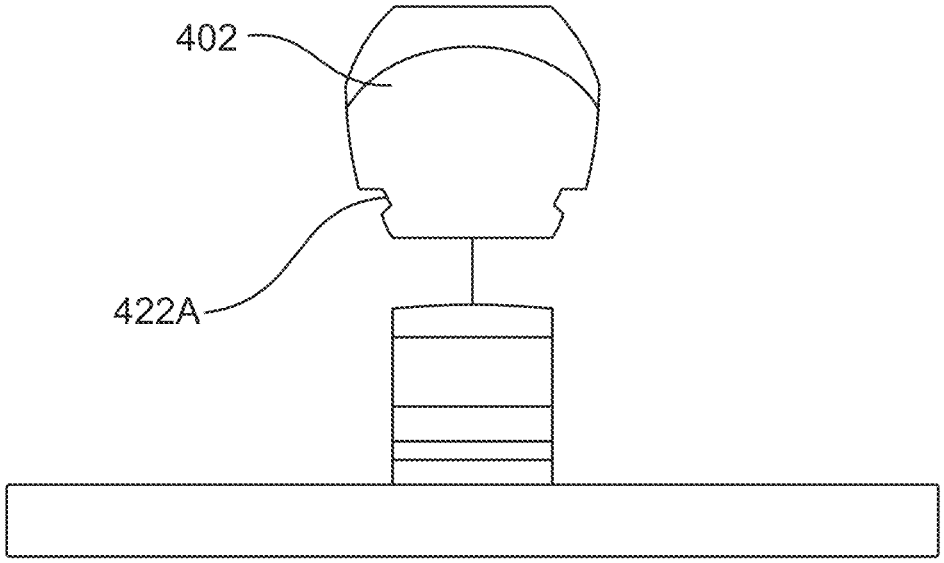
FIG. 12 is a side view of the ornament clamp male part apparatus according to some embodiments of the present invention.

FIG. 12 is a side view of the ornament clamp male part apparatus according to some embodiments of the present invention.

Figure 9A:
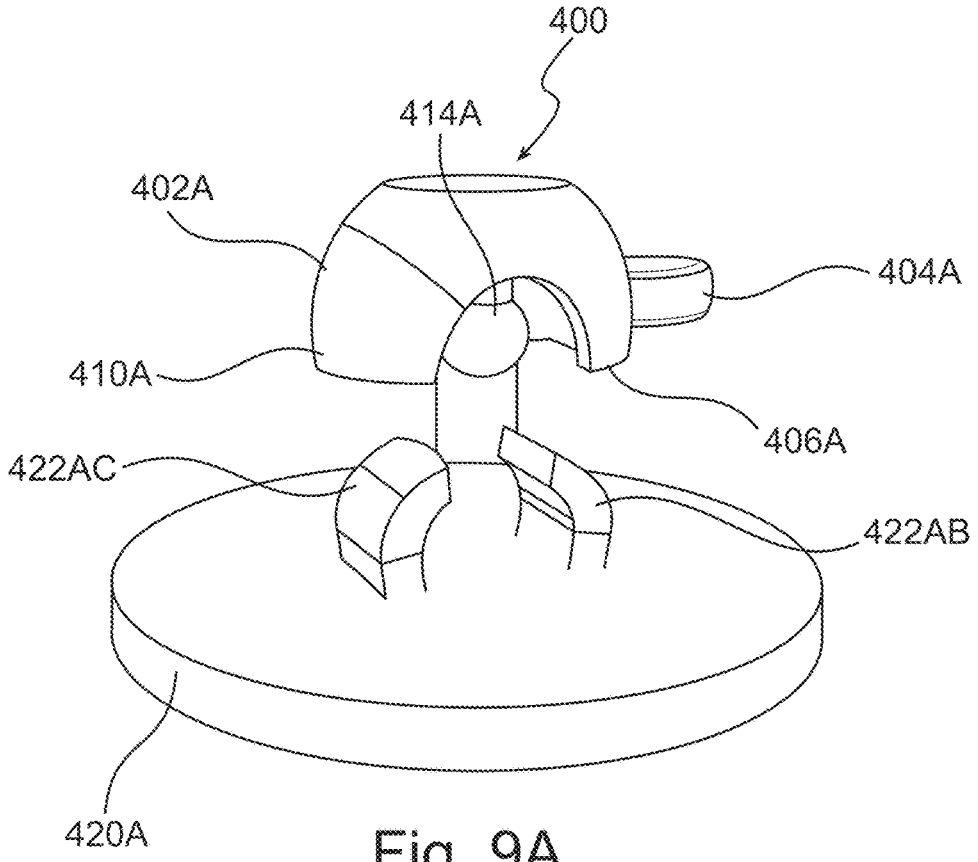
FIG. 9A is a perspective view of an ornament clamp apparatus according to some embodiments of the present invention.

FIG. 9A is a perspective view of an ornament clamp 400A apparatus according to some embodiments of the present invention.

According to this embodiment the female connector 402 has 3D circular shape having curved opening 406A and legs 412A and 408A designed to create niche on each side (in the FIG. only the left niche is seen 410A). Optionally the female connector 402A has gripping element 404A to enable easy departing of the clip. Optionally the female connector 402A has pin 414A designed to fit in the space 411A of the male connector, the pin ending has a ball shape which it's diameter is wider than the opening space 411, inserted by applying pressure, to enable secure connection.

The male connector is comprised of two curved legs 422A and 424B, each attached on one end to the ornament 420. The two distal ends of the legs are designed to be spaced from each other, creating an opening for inserting the lace.

Figure 10A:
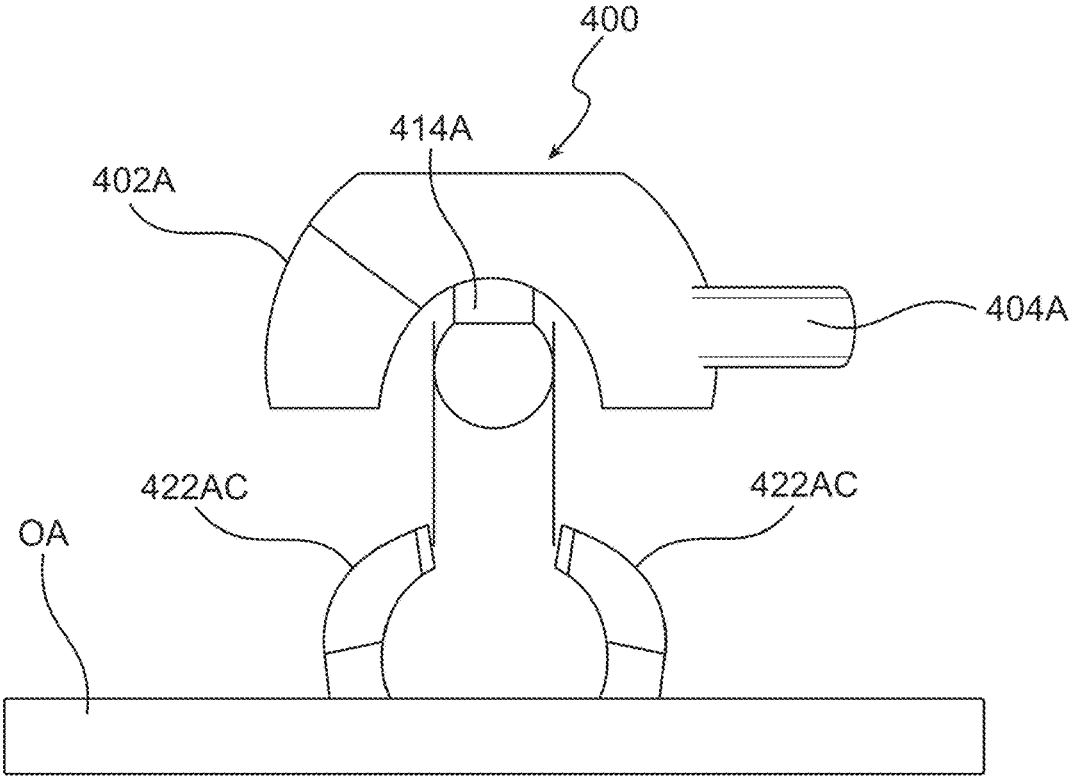
FIG. 10A is a side view of the ornament clamp apparatus according to some embodiments of the present invention.

FIG. 10A is a side view of the ornament clamp apparatus according to some embodiments of the present invention.

Figure 11A:
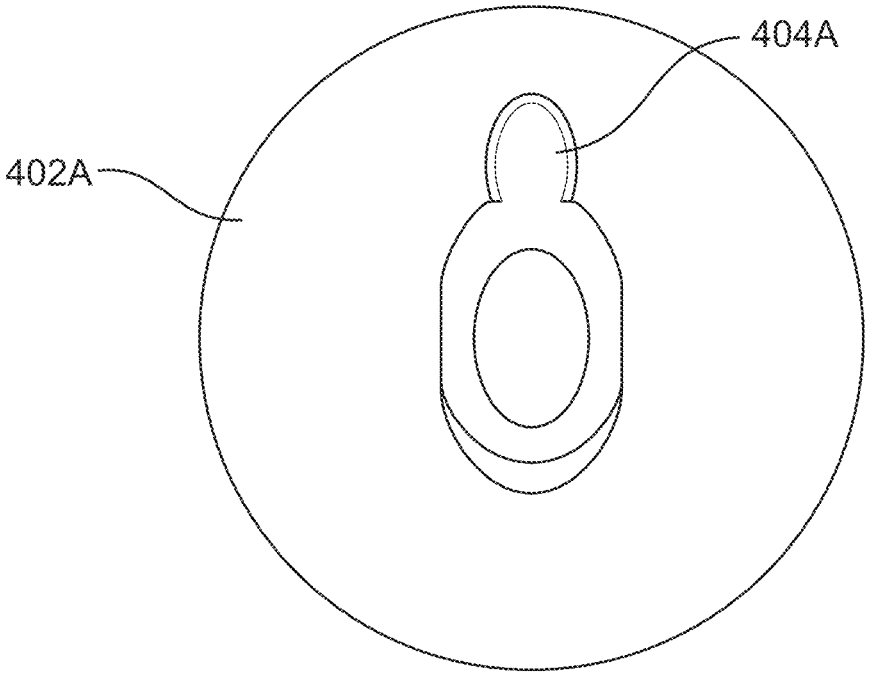
FIG. 11A is a top view of the ornament clamp female part apparatus according to some embodiments of the present invention.

FIG. 11A is a top view of the ornament clamp female part apparatus according to some embodiments of the present invention.

Figure 12A:
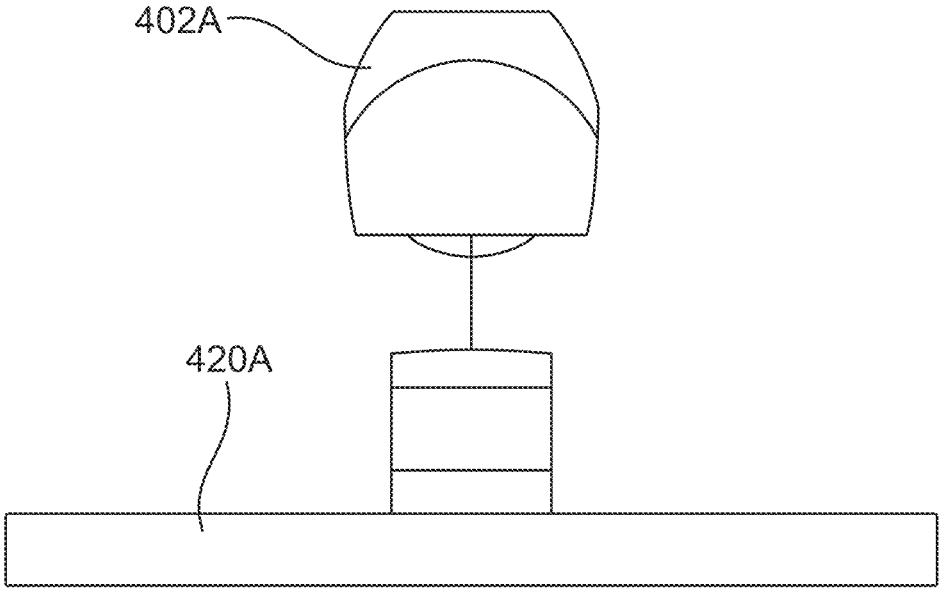
FIG. 12A is a side view of the ornament clamp male part apparatus according to some embodiments of the present invention.

FIG. 12A is a side view of the ornament clamp male part apparatus according to some embodiments of the present invention.

Figure 13:
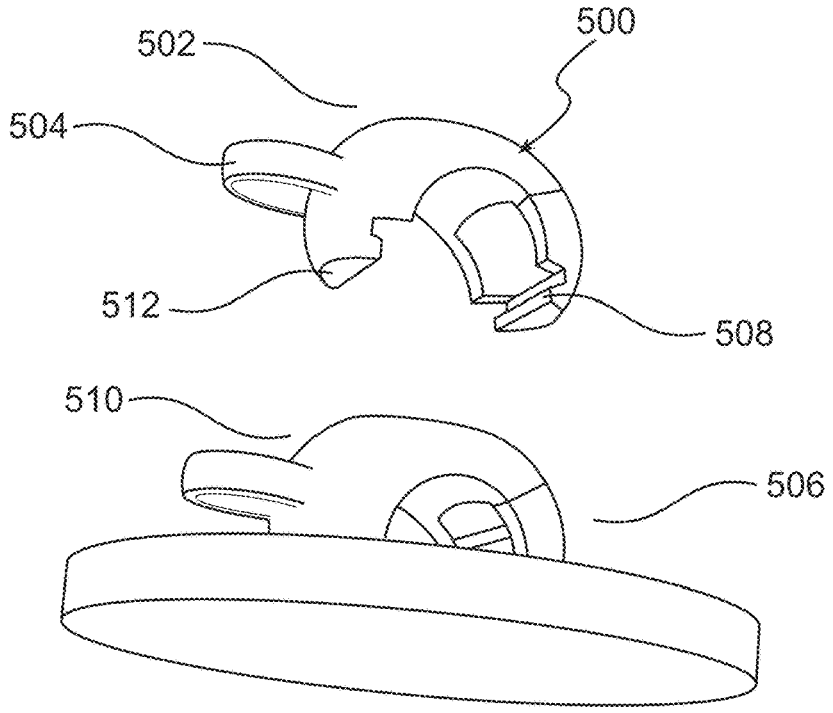
FIG. 13 is a perspective view of an ornament clamp apparatus according to some embodiments of the present invention.

FIG. 13 is a perspective view of an ornament clamp apparatus according to some embodiments of the present invention.

According to this embodiment the female connector 502 has 3D circular shape having curved opening 506 and legs 512 and 508 designed to create niche on each side (in this figure only the left niche is seen 510). Optionally the female connector 302 has gripping element 504 protruding from the closure to enable easy departing of the clip.

The male connector is comprised of two curved legs 522A and 524 B, each attached on one end to the ornament 520. The two distal ends of the legs are designed to be spaced from each other, creating an opening for inserting the lace. Each leg creating a bulge 524A, and 524B respectively, the niche is designed to enable the respective bulge to fit in, resulting secure connection between the two parts.

Figure 14:
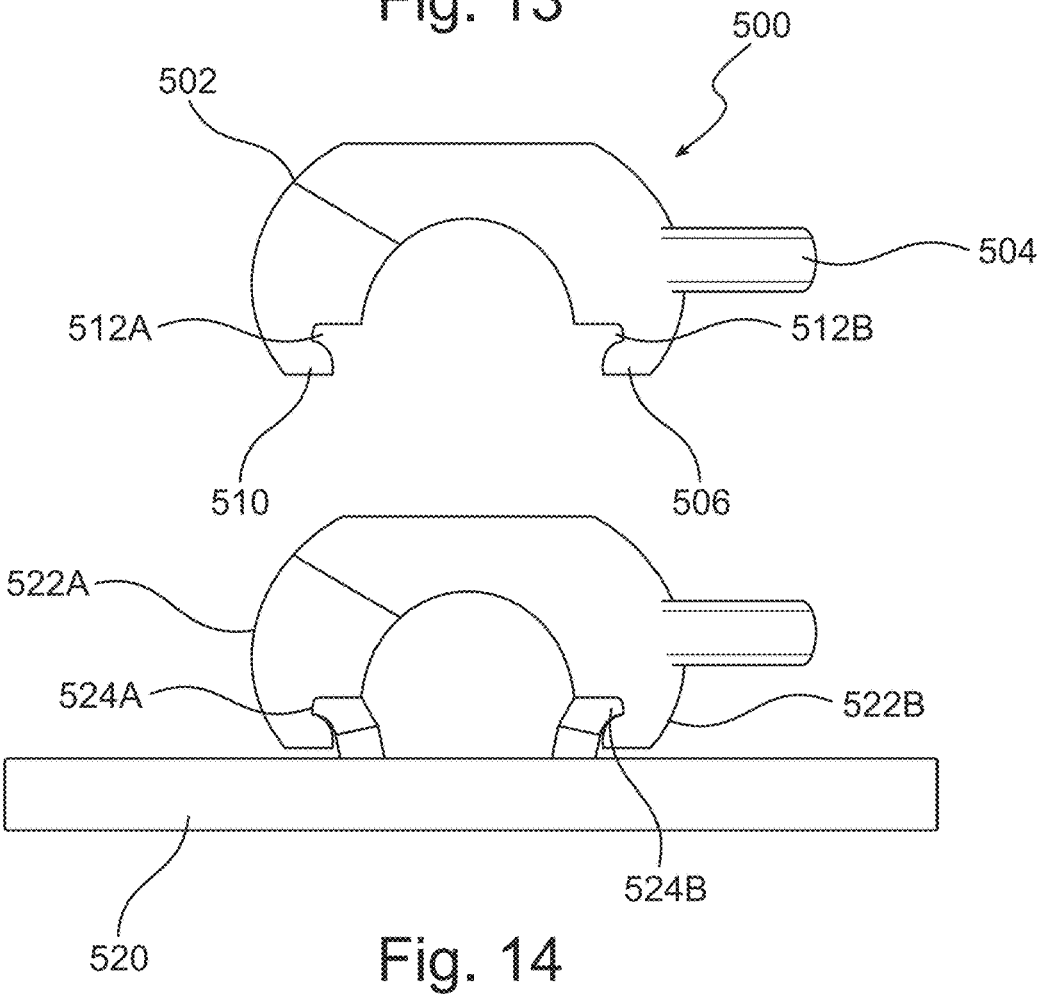
FIG. 14 is a side view of the ornament clamp apparatus according to some embodiments of the present invention.

FIG. 14 is a side view of the ornament clamp apparatus according to some embodiments of the present invention.

Figure 15:
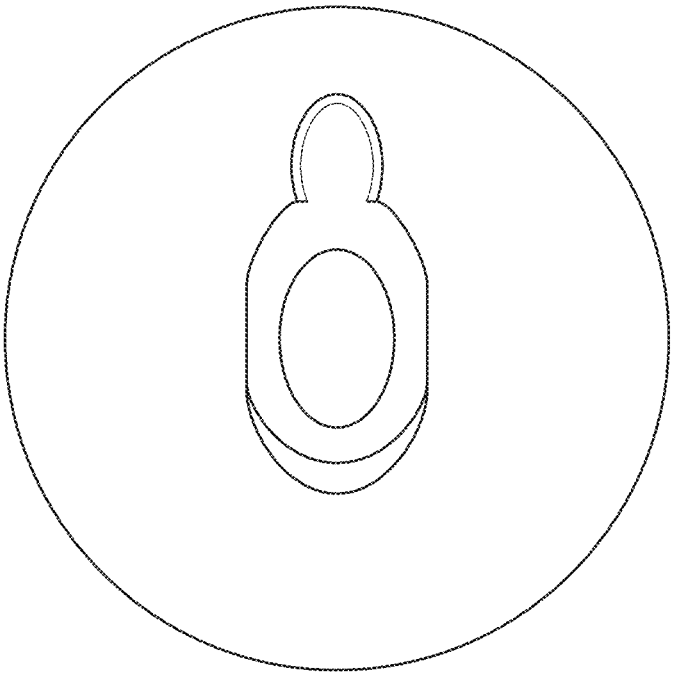
FIG. 15 is a top view of the ornament clamp female part apparatus according to some embodiments of the present invention.

FIG. 15 is a top view of the ornament clamp female part apparatus according to some embodiments of the present invention.

Figure 16:
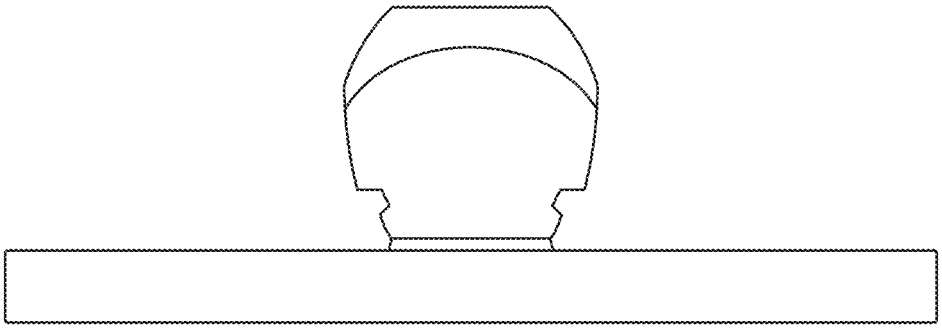
FIG. 16 is a side view of the ornament clamp male part apparatus according to some embodiments of the present invention.

FIG. 16 is a side view of the ornament clamp male part apparatus according to some embodiments of the present invention.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. An ornament clamp apparatus attachable to a lace comprising:

an ornament body and a clamping assembly for cooperating therewith for attaching said ornament body to said lace; said clamping assembly comprises a male connector and a female connector, said male connector has curved arms extending from said ornament body, and said female connector has an open-shape structure which fits tightly onto the male connector;

wherein the female connector has a 3D circular shape having a curved opening;

wherein the curved arms have ends that curve toward each other while maintaining a separation distance in between them, wherein the circular shape fits tightly on the curved arms, hence the integration creating inner pressure between the male connector and the female connector to maintain secure connection;

wherein the female connector comprises legs designed to create niches on each side of the curved opening and the male connector has bulges near a lower edge of the male connector, said bulges adapted to be fixedly attached to the female connector niches;

wherein the female connector has a pin extending from the inner opening, said pin having a ball shape ending, designed to fit into a space within the male connector, wherein the ball diameter is larger than the space length, creating a secure connection between the male and female connectors;

wherein the curved arms closure tightens the male connector parts shortening the space between the male connector parts.

2. The ornament clamp apparatus of claim 1, wherein the two curved arms are semi-flexible arms.

3. The ornament clamp apparatus of claim 1, wherein, the female connector has a U-shaped structure which fits onto the male connector.

4. The ornament clamp apparatus of claim 1, wherein the female connector and the male connector are connected by sliding the female connector from the side to the male connector.

* * * * *